US009346287B2

(12) United States Patent
Birecki et al.

(10) Patent No.: US 9,346,287 B2
(45) Date of Patent: May 24, 2016

(54) HARD IMAGING DEVICE AND METHOD THEREOF

(71) Applicant: Hewlett-Packard Development Company, L. P., Houston, TX (US)

(72) Inventors: Henryk Birecki, Palo Alto, CA (US); Napoleon Leoni, San Jose, CA (US); Omer Gila, Cupertino, CA (US); Thomas C Anthony, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 139 days.

(21) Appl. No.: 13/633,493

(22) Filed: Oct. 2, 2012

(65) Prior Publication Data

US 2013/0271516 A1 Oct. 17, 2013

Related U.S. Application Data

(62) Division of application No. 12/547,597, filed on Aug. 26, 2009, now abandoned.

(51) Int. Cl.

| | |
|---|---|
| ***B41J 2/01*** | (2006.01) |
| ***B41J 11/00*** | (2006.01) |
| ***B41J 2/005*** | (2006.01) |

(52) U.S. Cl.
CPC ..... *B41J 11/0015* (2013.01); *B41J 2/0057* (2013.01)

(58) Field of Classification Search
CPC ..... B41J 2/22; B41J 2/0057; B41J 2/205
USPC ..... 347/103, 116, 154, 14, 107; 430/124, 430/125.3
See application file for complete search history.

(56) References Cited

U.S. PATENT DOCUMENTS

| | | | | |
|---|---|---|---|---|
| 6,716,562 | B2 * | 4/2004 | Uehara et al. | 430/125.3 |
| 7,992,994 | B2 * | 8/2011 | Kobayashi et al. | 347/107 |
| 2009/0195579 | A1 * | 8/2009 | Tousi et al. | 347/14 |

* cited by examiner

*Primary Examiner* — Lam Nguyen
(74) *Attorney, Agent, or Firm* — HP Inc. Patent Department"

(57) ABSTRACT

An imaging method includes coating a transfer member with an adhesion promoter in a liquid state, changing the adhesion promoter on the transfer member from the liquid state to at least one of a solid state and a get state, depositing a liquid marking agent on the solidified adhesion promoter corresponding to an image, changing a state of the adhesion promoter from the solid state to the flowable state, and transferring the liquid marking agent and the adhesion promoter in the flowable state from the transfer member to a substrate to form a hard version of the image thereon.

16 Claims, 4 Drawing Sheets

HARD IMAGING DEVICE AND METHOD THEREOF

CROSS-REFERENCE TO RELATED APPLICATION

This application is a divisional of co-pending U.S. patent application Ser. No. 12/547,597, filed Aug. 26, 2009 in which the entire contents are hereby incorporated by reference as though fully set forth herein.

BACKGROUND OF THE DISCLOSURE

Imaging devices capable of printing images upon substrates such as paper are ubiquitous and used in many applications including monochrome and color applications. The use and popularity of these devices continues to increase as consumers at the office, home and in industry have increased their reliance upon electronic and digital devices, such as computers, digital cameras, telecommunications equipment, etc. A variety of methods of forming hard images upon the substrates exist and are used in various applications and environments, such as home, the workplace and commercial printing establishments. Some examples of devices capable of providing different types of printing include laser printers, impact printers, inkjet printers, commercial digital presses, etc. The various printing methods and devices involve different technologies to form hard images upon substrates and the individual types of methods and devices may be more suitable for one or more application or use compared with other applications or uses. Hard imaging devices using offset printing are becoming more in demand.

DESCRIPTION OF THE DRAWINGS

Exemplary non-limiting embodiments of the general inventive concept are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures.

DETAILED DESCRIPTION

The present general inventive concept is directed towards hard imaging devices and imaging methods to form hard images upon substrate. In one example, devices and methods are disclosed which utilize inkjet printing in en offset printing arrangement. For example, an inkjet print head is utilized to provide a plurality of drops of a liquid marking agent upon a transfer member in one embodiment. Such a hard imaging device provides the benefits of offset printing such as an ability to print on a variety of substrates and the benefits of inkjet printing such as scalability, simplicity and use of a variety of liquid marking agents. Thus, different compositions of the squid marking agent are possible and may utilize a non-aqueous carrier fluid or vehicle which contains pigments (e.g. ink particles) to form images in one embodiment of the present general inventive concept. Examples of non-aqueous carriers may include solvent (e.g. alcohol) and/or oil-based carrier (e.g. isopar L). The pigments may be smaller than typical toner particles and may comprise different pigments for color applications or a single color for monochrome applications.

In one embodiment, the pigments diameters are within a range of, but not limited to, 50-300 nm. After the drops are deposited on the transfer member, at least a portion of a carrier fluid of the liquid marking agent may be removed and pigments of the liquid marking agent remaining upon the transfer member are transferred to the substrate to produce hard versions of images upon the substrate. An ability of the hard imaging device of the present general inventive concept to print with a variety of liquid marking agents on the transfer member, to protect the transfer member from premature degradation and to adequately transfer the image from the transfer member to the substrate allows cost-effective production of high-quality images. Additional embodiments and aspects are described hereafter.

Figure 1:
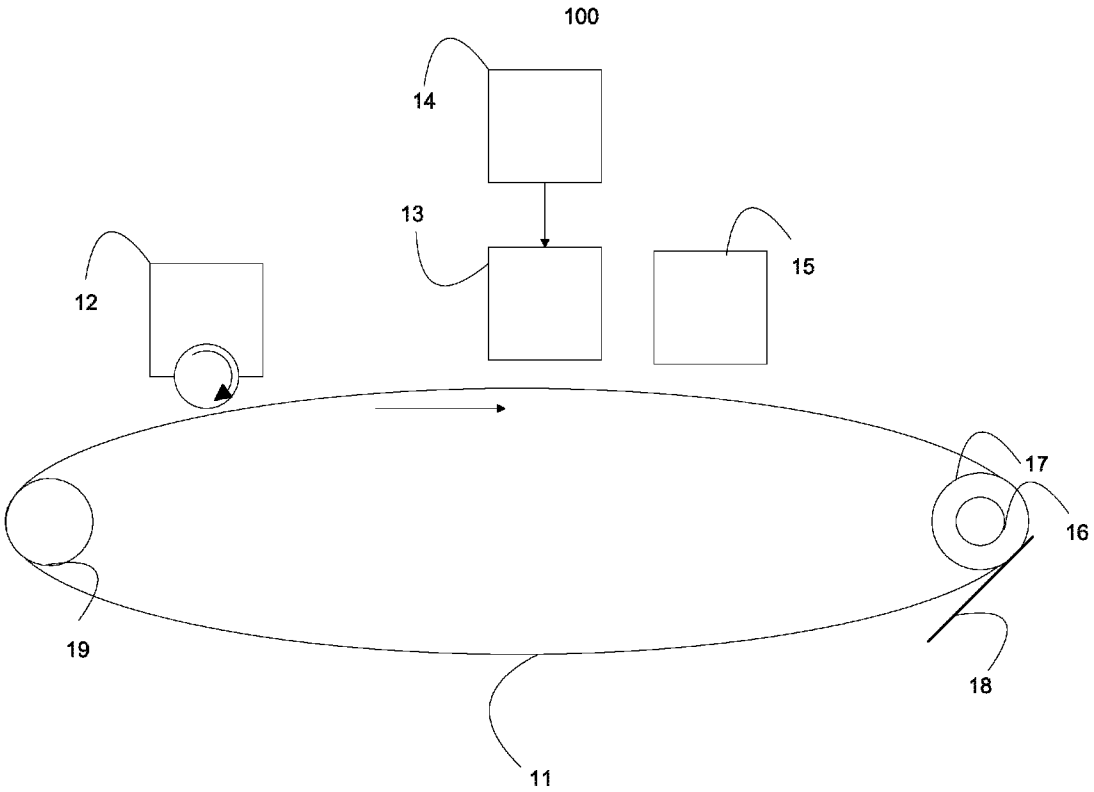
FIG. 1 is an Illustrative representation of a hard imaging device according to an embodiment of the present general inventive concept.

FIG. 1 is an illustrative representation of a hard imaging device according to an embodiment of the present general inventive concept. Referring to FIG. 1. The hard imaging device 100 includes a costing unit 12, a printing unit 13, a control unit 14, a development unit 15, a heating unit 16, and a transferring unit 17. In the present embodiment, the herd imaging device 100 also includes a transfer member 11 adjacent to each of the costing unit 12, the printing unit 13, the control unit 14, the development unit 15, the heating unit 16, and the transferring unit 17.

Referring to FIG. 1, in the present embodiment the transfer member 11 is configured to receive and transfer an adhesion promoter and a liquid marking agent to a substrate 18. In one embodiment, the transfer member 11 is a transfer belt and may be referred to as a transfer blanket. Other transfer members are possible, such as a drum or other structure appropriate to receive and transfer a liquid marking agent. The transfer blanket may include one or more guide members 19, for example, in a form of rollers to guide the transfer blanket. In one embodiment, for example, the transfer blanket 11 is at room temperature such as 20° C. and moves in a direction opposite to the coating unit 12. In one embodiment, the coating unit 12 may be a spray unit or slot coater and have no motion.

Figure 2:
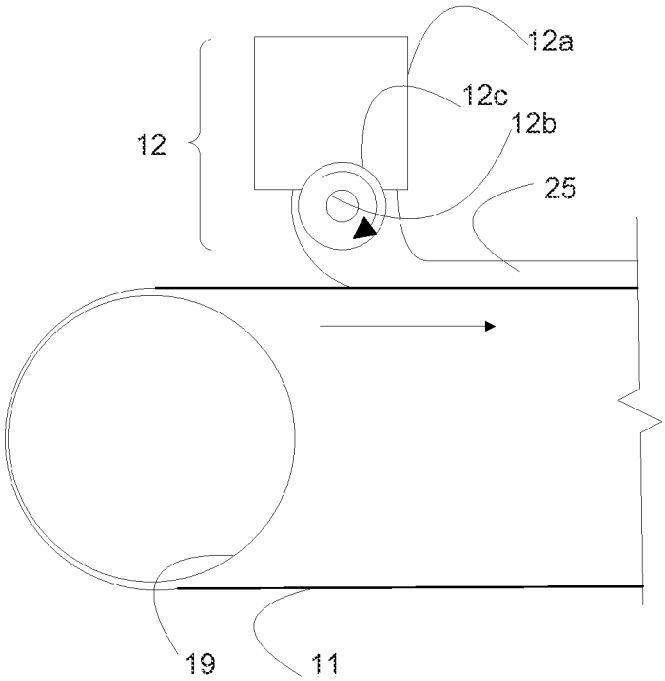
FIG. 2 is an illustrative representation of a coating unit of a hard imaging device according to an embodiment of the present general inventive concept.

FIG. 2 is an illustrative representation illustrating a coating unit 12 according to an embodiment of the present general inventive concept. Referring to FIGS. 1 and 2, the coating unit 12 is configured to coat the transfer member 11 with the adhesion promoter in a liquid state and to change a state of the adhesion promoter on the transfer member 11 from the liquid state to a solid or gel state. Applying adhesion promoter in the liquid state allows for a variety of application techniques and creates a thin, continuous, non-porous layer on transfer member 11. Thus, the liquid marking agent can be deposited on the adhesion promoter on the transfer member 11 in the solid state. Consequently, a variety of liquid marking agents can be deposited thereon. In the present embodiment, the coating unit 12 includes a container 12*e* configured to hold the adhesion promoter, a heater 12*b* configured to heat the adhesion promoter, for example, above a respective melting point thereof to maintain it in the liquid state, and en application roller 12*c* configured to apply the adhesion promoter, for example, as an adhesion promoter layer 25 onto the transfer blanket 11. In one embodiment, the application roller 12*c* is a reverse roller to rotate in a direction opposite to a direction of the transfer blanket 11.

In some embodiments, the adhesion promoter is provided in a continuous layer upon an entirety of the surface of the transfer member 11. Thus, the adhesion promoter layer 25 can protect the transfer member 11 from premature degradation, for example, from IR or ion bean (corona) irradiation. Alternatively, the adhesion promoter layer 25 is applied as an adhesive promoter layer only upon portions of the transfer member 11 which receive the image. In the present embodiment, the layer may have a thickness in a range of, but not limited to, 200 nm to 1000 nm. In other embodiments, the heater 12*b* may be separate from or integrated into the container 12*a* and/or application roller 12*c*.

In the present embodiment the adhesion promoter may be at least one of a wax, resin and polymer, for example, having a surface tension compatible with the respective liquid marking agent so that drop size of the liquid marking agent on a promoter surface can be adequately controlled, and having a solid state at room temperature. Thus, when the liquefied adhesion promoter is applied to the transfer blanket 11 having a temperature of approximately room temperature the adhesion promoter solidifies when or shortly after contacting the transfer member 11. In one embodiment the adhesion promoter may be Poly(methyl methacrylate) (PMMA) having a melting point of approximately 130° C. Thus, for example, the heater 120*b* maintains a temperature of above 130° C. such as 150° C. to maintain PMMA in the liquid state. When liquefied PMMA is applied to the transfer blanket 11 having a temperature below 130° C. such as room temperature, PMMA changes from the liquid state to the solid state.

Referring to FIG. 1, the printing unit 13 is configured to deposit the liquid marking agent on the solidified adhesion promoter on the transfer member 11. The printing unit 13, for example, deposits a liquid marking agent on the solidified adhesion promoter on the transfer member 11 moving in a clockwise direction. In one embodiment, the printing unit 13 is an inkjet print head which is configured to eject a plurality of drops of a liquid marking agent which correspond to an image which are used to form hard images upon the substrate 18. In example embodiments, the printing unit 13 may be configured as a piezoelectric inkjet print head or a thermal inkjet print head arranged to accommodate aqueous or non-aqueous carriers in at least one embodiment as is old and we-known to one of ordinary skill in the art.

Referring to FIG. 1, for example, the control unit 14 processes image data and controls the nozzles of the printing unit 13 to eject drops of the liquid marking agent at appropriate locations to form the image specified by the image data. In one embodiment, the control unit 14 is arranged to access image data of images to be formed, process data, control data access and storage, issue commands, and control other operations of the hard imaging device 100 with respect to imaging. More specifically, the control unit 14 may access image data and control the printing unit 13 to eject drops of liquid marking agent at a plurality of selected locations and corresponding to the images to be formed as specified by the image data. In one embodiment, the control unit 14 may comprise processing circuitry configured to implement desired programming in at least one embodiment. For example, the processing circuitry may be implemented as one or more of a processor and/or other structure configured to execute executable instructions including, for example, software and/or firmware instructions, and/or hardware circuitry. Exemplary embodiments of processing circuitry include hardware logic, PGA, FPGA, ASIC, state machines, and/or other structures alone or in combination with a processor. These examples of the control unit 14 are for illustration and other configurations are possible.

Referring to FIG. 1, the development unit 15 is downstream of the printing unit 13 and is configured to develop the drops to substantially fix a size of areas of the drops upon the transfer member 11. For example. In one embodiment the pigments may condense at a surface of the adhesion promoter surface. In exemplary embodiments, the hard imaging device 100 may include a development device 15 old and well-known to one of ordinary skill in the art. In one embodiment, the development unit 15 imparts an electrical force (e.g. electrical field, electrical charge, electrons) to the liquid marking agent deposited upon the transfer member 11, for example, and separates the pigments of the liquid marking agent from the carrier fluid.

Referring to FIG. 1, the heating unit 18 is configured to heat the solidified adhesion promoter on the transfer member 11 above its respective softening point to change the state of the solidified adhesion promoter to the flowable state, for example, prior to it being transferred to the substrate 18. In one embodiment, the heating unit 16 may apply a temperature of approximately 140° C. to the solidified PMMA to change it into the flowable or liquid state. Changing the state of the adhesion promoter from the solid state to the flowable state assists with transfer of the image to the substrate 18 such as adhering the ink to the substrate 18 and reducing penetration of the pigments, for example, into fibers of the substrate 18. In one embodiment, various components of FIG. 1 may be combined.

Figure 3:
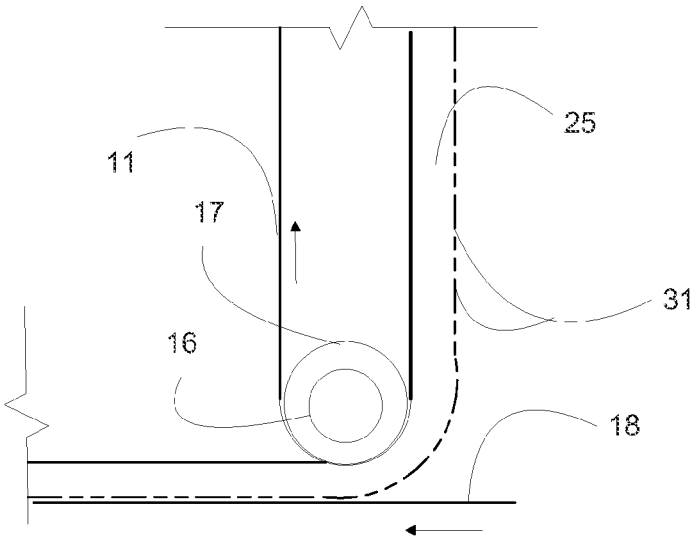
FIG. 3 is an illustrative representation of a heating unit and transferring unit of a hard imaging device according to an embodiment of the present general inventive concept.

FIG. 3 is an illustrative representation of a heating unit and transferring unit of an embodiment of the present general inventive concept. Referring to FIGS. 1 and 3, the transferring unit 17 is configured to transfer the liquid marking agent corresponding to the image and the adhesion promoter in the flowable state to the substrate 18. In one embodiment, as ilustrated in FIG. 3, the pigments 31 and adhesion promoter 25 are transferred from the transfer blanket 11 to the substrate 18. In which the pigments 31 are disposed between the adhesion promoter and the substrate 18. Thus, the image maintains a constant glossiness. The pigments 31 and adhesion promoter 25 transferred from the transfer member 11 to the substrate 18 form a hard version of the image on the substrate 18. In one embodiment, the heating unit 16 and transferring unit 17 can be integrated as one unit. In other embodiments, the healing unit 16 and the transferring unit 17 can be separate from each other. The transferring unit 17 may use heat, electrical charge and/or pressure to assist with the transfer of the pigments to the substrate 18 in illustrative examples.

Figure 4:
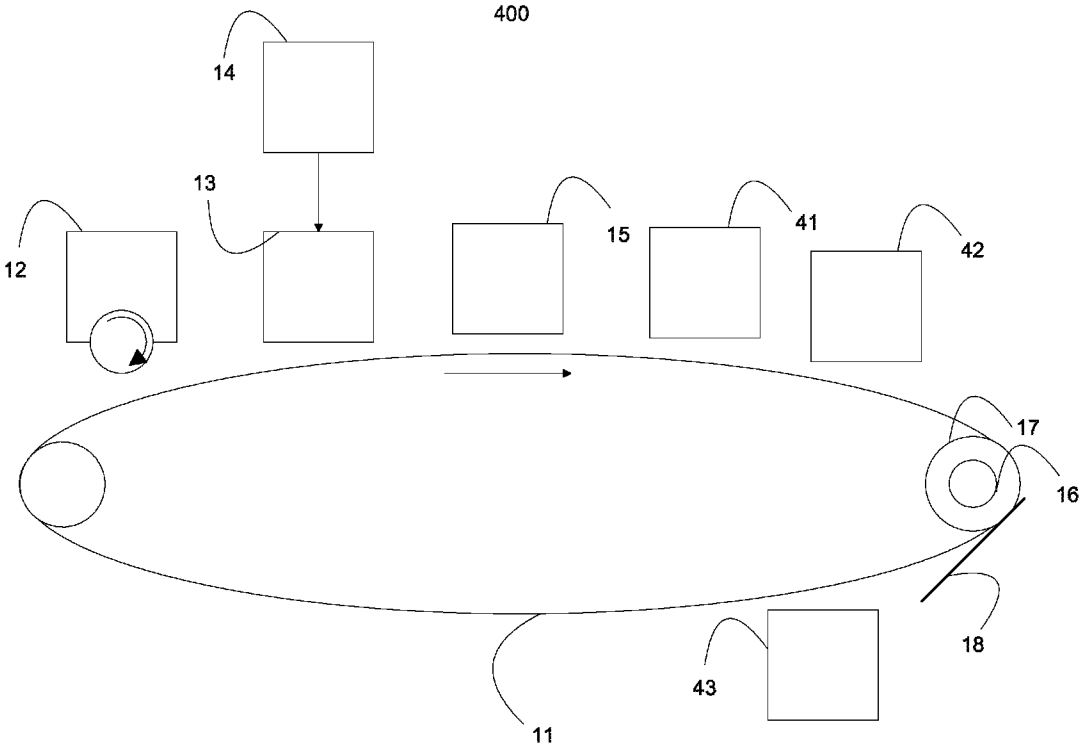
FIG. 4 is an illustrative representation of a hard imaging device according to another embodiment of the present general inventive concept.

FIG. 4 is an illustrative representation of a hard imaging device according to another embodiment of the present general inventive concept. Referring to FIG. 4, the hard imaging device 400 includes the components previously described with reference to FIG. 1 and also includes a removal unit 41, a drying unit 42 and a cooling unit 43 adjacent to the transfer member 11.

Referring to FIG. 4, the removal unit 41 is downstream of the development unit 16 and is configured to expose the liquid marking agent upon the transfer member 11 to one or more process conditions to remove at least a portion of the carrier fluid of the liquid marking agent deposited upon the transfer member 11 in one embodiment. In some embodiments, the removal unit 41 may include one or more units capable of removing at least a portion of the carrier fluid and may be implemented in various ways known to one of ordinary skill in the art. For example, in some configurations, the removal unit 41 may include one or more physical (mechanical) removal devices to physically or mechanically remove the carrier fluid and a drying unit 42 configured to cause evaporation of remaining carrier liquid. In example embodiments, the removal unit 41 may include a drying unit 42 alone or in addition to physical removal devices to provide process conditions to remove the carrier fluid. For example, the drying unit 42 may comprise one or more IR lamps over one or more of the surfaces of the transfer member 11 or may be configured to blow heated air over one or more of the surfaces of the transfer member 11 in example arrangements. The adhesion promoter layer covers the transfer member 11 to prevent premature degradation, for example, from IR or ion beam (corona) irradiation and to allow a variety of liquid marking agents to be deposited thereon.

Referring to FIG. 4, the cooling unit 43 is configured to cool the transfer blanket 11, for example, to room temperature. Typically the transfer blanket 11 is heated in the transfer unit 17 to high temperature and needs to be cooled prior to an adhesion promoter coating by coating unit 12. Cooling, for example, can be accomplished by exposure to cold air (jetted or not), or by passing through water-cooled rollers. In other embodiments, one or more of the illustrated components of FIG. 4 may be omitted or implemented differently.

Figure 5:
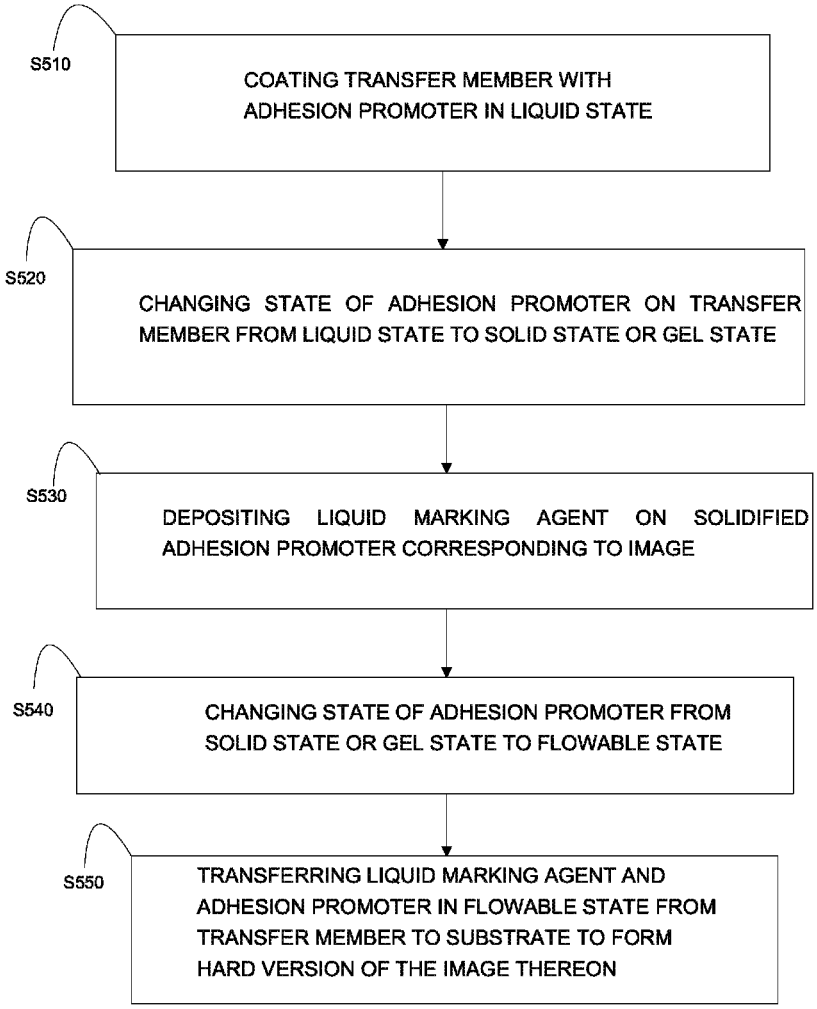
FIG. 5 is a flowchart illustrating an imaging method according to an embodiment of the present general inventive concept.

FIG. 5 is a block diagram illustrating an imaging method according to an embodiment of the present general inventive concept. Referring to FIG. 5, in operation S510, a transfer member is coated with an adhesion promoter in a liquid state. In operation 8520, a state of the adhesion promoter on the transfer member is changed from the liquid state to a solid or gel state. In operation S530, a liquid marking agent is deposited on the solidified adhesion promoter corresponding to an image. The liquid marking agent, for example, may include an ink having pigments and a carrier fluid and the liquid marking agent may be elected using an inkjet print head. In operation S540, the state of the adhesion promoter is changed from the solid state to the flowable state. In operation S550, the liquid marking agent and the adhesion promoter in the flowable state is transferred from the transfer member to a substrate to form a hard version of the image thereon. In one embodiment, transferring the liquid marking agent and the adhesion promoter in the flowable state in operation S560 further includes depositing the pigments between the adhesion promoter and the substrate.

In one embodiment, coating a transfer member with an adhesion promoter in a liquid state in operation S510 of the imaging method illustrated in FIG. 5 further includes heating the adhesion promoter above a respective melting temperature thereof. In one embodiment, the imaging method may also include separating the pigments from the carrier fluid and removing at least a portion of the carrier fluid.

The present genera inventive concept has been described using non-limiting detailed descriptions of embodiments thereof that are provided by way of example and are not intended to limit the scope of the general inventive concept. It should be understood that features and/or operations described with respect to one embodiment may be used with other embodiments and that not all embodiments of the general inventive concept have all of the features and/or operations illustrated in a particular figure or described with respect to one of the embodiments. Variations of embodiments described will occur to persons of the art. Furthermore, the terms "comprise," "include," "have" and their conjugates, shall mean, when used in the disclosure and/or claims. "including but not necessarily limited to."

It is noted that some of the above described embodiments may describe the best mode contemplated by the inventors and therefore may include structure, acts or details of structures and acts that may not be essential to the general inventive concept and which are described as examples. Structure and acts described herein are replaceable by equivalents, which perform the same function, even if the structure or acts am different, as known in the art. Therefore, the scope of the general inventive concept is limited only by the elements and limitations as used in the claims.

What is claimed is:

1. A hard imaging device, comprising:

a transfer member configured to receive and transfer an adhesion promoter and a liquid marking agent to a substrate;

a coating unit configured to heat the adhesion promoter above a respective melting point thereof and coat the transfer member with a non-porous layer of the adhesion promoter in a liquid state and to change the adhesion promoter on the transfer member from the liquid state to at least one of a solid state and a gel state;

a printing unit configured to deposit the liquid marking agent directly on the solidified adhesion promoter;

a control unit configured to control the printing unit to deposit the liquid marking agent directly on the solidified adhesion promoter corresponding to an image to be formed;

a developer unit configured to develop the liquid marking agent deposited directly on the solidified adhesion promoter;

a heating unit configured to heat the solidified adhesion promoter with the liquid marking agent deposited directly thereon above a respective softening point thereof and to change the solidified adhesion promoter to the liquid state; and a transferring unit configured to transfer the liquid marking agent corresponding to the image and the adhesion promoter in the liquid state from the transfer member to the substrate.

2. The device of claim 1, wherein the coating unit includes a heater to heat the adhesion promoter above the respective melting point thereof and maintain the adhesion promoter in the liquid state before coating on the transfer member.

3. The device of claim 1, wherein the transfer member comprises:

an intermediate blanket.

4. The device of claim 1, wherein the liquid marking agent comprises:

an ink having pigments and a carrier fluid.

5. The device of claim 4, further comprising:

a development unit configured to develop the ink on the transfer member; and a removal unit configured to remove at least a portion of the carrier fluid.

6. The device of claim 1, wherein the printing unit is configured to deposit the liquid marking agent directly on a substantially uniform surface of the solidified adhesion promoter.

7. The device of claim 1, wherein, with the liquid marking agent and the adhesion promoter transferred from the transfer member to the substrate, pigments of the liquid marking agent are disposed between and in direct contact with both the adhesion promoter and the substrate.

8. The device of claim 1, wherein the heating unit is configured to heat the solidified adhesion promoter above the respective softening point and change the solidified adhesion promoter to the liquid state prior to transfer of the liquid marking agent and the adhesion promoter to the substrate.

9. The device of claim 1, wherein the heating unit is configured to heat the solidified adhesion promoter to approximately 140 degrees Celsius to change the solidified adhesion promoter to the liquid state.

10. The device of claim 1, wherein the adhesion promoter is to be:

heated to the liquid state, thereafter, coated on the transfer member, thereafter, changed to at least one of a solid state and a gel state, thereafter, reheated to the liquid state, and thereafter, transferred to the substrate.

11. An inkjet printing apparatus, comprising:

an intermediate blanket configured to receive and transfer an adhesion promoter and an ink having pigments and a carrier fluid to a substrate;

a coating unit configured to heat the adhesion promoter above a respective melting point thereof and coat the intermediate blanket with a non-porous layer of the adhesion promoter in a liquid state and to change the adhesion promoter on the intermediate blanket from the liquid state to at least one of a solid state and a gel state;

an inkjet print head configured to deposit the ink directly on the solidified adhesion promoter;

a control unit configured to control the inkjet print head to deposit the ink directly on the solidified adhesion promoter corresponding to an image to be formed;

a development unit configured to develop the deposited ink on the solidified adhesion promoter;

a heating unit configured to heat the solidified adhesion promoter with the developed ink deposited directly thereon above a respective softening point thereof and to change the solidified adhesion promoter to the liquid state; and a transferring unit configured to transfer the developed ink corresponding to the image and the adhesion promoter in the liquid state from the intermediate blanket to the substrate.

12. The apparatus of claim 11, further comprising:

a removal unit configured to remove at least a portion of the carrier fluid of the deposited ink.

13. The apparatus of claim 11, wherein the heating unit is configured to heat the solidified adhesion promoter above the respective softening point and change the solidified adhesion promoter to the liquid state prior to transfer of the developed ink and the adhesion promoter to the substrate.

14. The apparatus of claim 11, wherein the heating unit is configured to heat the solidified adhesion promoter to approximately 140 degrees Celsius to change the solidified adhesion promoter to the liquid state.

15. The apparatus of claim 11, wherein, with the developed ink and the adhesion promoter transferred from the intermediate blanket to the substrate, the pigments of the ink are disposed between and in direct contact with both the adhesion promoter and the substrate.

16. The apparatus of claim 11, wherein the adhesion promoter is to be:

heated to the liquid state, thereafter, coated on the transfer member, thereafter, changed to at least one of a solid state and a gel state, thereafter, reheated to the liquid state, and thereafter, transferred to the substrate.

* * * * *